US006883837B1

(12) United States Patent
Lin

(10) Patent No.: US 6,883,837 B1
(45) Date of Patent: Apr. 26, 2005

(54) FLUSH BOLT MECHANISM

(76) Inventor: Ching-Tien Lin, No. 2, Lane 112, Chu-Yuan Road, Hsin-Chung City, Taipei Hsien (TW)

( * ) Notice: Subject to any disclaimer, the term of this patent is extended or adjusted under 35 U.S.C. 154(b) by 0 days.

(21) Appl. No.: 10/751,970

(22) Filed: Jan. 7, 2004

(51) Int. Cl.[7] ..... F05C 1/06
(52) U.S. Cl. ..... 292/33; 292/332; 292/DIG. 21
(58) Field of Search ..... 292/32, 33, 35, 292/36, 332, 335, DIG. 21; 70/107

(56) References Cited

U.S. PATENT DOCUMENTS 1,094,962 A * 4/1914 Arens et al. ..... 292/333
3,582,122 A * 6/1971 Foster et al. ..... 292/335
4,005,886 A 2/1977 Lirette
4,099,753 A * 7/1978 Gwozdz et al. ..... 292/177
4,445,717 A 5/1984 Imhoff
5,076,620 A 12/1991 Campbell et al.
6,324,876 B1 * 12/2001 Prevot et al. ..... 70/107
6,409,231 B1 6/2002 Rusiana

* cited by examiner

*Primary Examiner*—Gary Estremsky
(74) *Attorney, Agent, or Firm*—Shoemaker and Mattare

(57) ABSTRACT

A flush bolt mechanism includes a frame, a slide guide bracket, a plunger reciprocally retained in the slide guide bracket having two first slots, a trigger member mounted to the plunger and reciprocally movable between a retracted position and an extended position, an elongated linkage assembly extending through the frame, and a resilient member biasing the linkage assembly toward a downward direction. The linkage assembly having a first end coupled to the shaft. The plunger includes two second slots and a shaft movable in the slots. The first and second slots are offset at an angle such that when the trigger member is activated to the retracted position, a second end of the linkage assembly is carried upwardly for latching engagement in the associated strike; when the trigger member is released from the retracted position, the second end of the linkage assembly is carried downwardly for disengagement with the strike.

16 Claims, 5 Drawing Sheets

FLUSH BOLT MECHANISM

FIELD OF THE INVENTION

The present invention relates to latches or bolts used in doorways, and more particularly, to a flush bolt mechanism used bolting an inactive one of a pair of swinging double doors.

BACKGROUND OF THE INVENTION

Fire doors are provided in buildings to present passage and spread of fires from one portion of the building to other portions. Various types of fire doors are provided to close different kinds of openings generally found in buildings, such as double swing doors. Typical double swing doors comprises an active door and an inactive door.

Flush bolt mechanisms are used on what is normally termed the inactive door of a pair of double swing doors. The flush bolt mechanism includes the male member, i.e. generally a trigger, of a door latch combination with the female bolt receiving plate or strike positioned if the opposing active door. While a major portion of the flush bolt mechanism is mounted on what is termed the free side of the inactive door, an additional latch bolt and guide mechanism are connected to the flush bolt mechanism by a long linkage to provide a locking bolt that is normally received in a second strike positioned in the lentil of the doorway.

Flush bolt mechanisms are shown and described at U.S. Pat. Nos. 4,005,886, 4,445,717, and 5,076,620. However, with a double set of swing doors, a space between opposing door jambs, in the walls in which the doors are mounted, has to be provided for clearance between the jamb and the pivoting side of each of the opposing doors plus clearance between the free sides of the opposing doors. Heretofore, in order to adjust the doors and the door locking mechanisms thereon for a double set of swing doors, additional shimming has to be provided for the hinges in the doorjambs. As the clearances in a double set of swing doors are greater than that found in a single swing door, means for adjusting a door bolt mechanism to accommodate varying clearances between the double swing doors and the door sash has to be developed and employed.

Referring to FIGS. 1–2, U.S. Pat. No. 6,409,231 discloses a conventional flush bolt mechanism 1 comprises an elongated rod type linkage 2, a slide guide 3, a link 5, first and second coil springs 5 and 6, a latch bolt 7, a trigger member 8, a plunger (not labeled) and a bell crank 9. The latch bolt 7 is connected to the main mechanism by the elongated rod type linkage 2. The elongated rod type linkage 2 extends slidably through the slide guide 3. A lower portion of the elongated rod type linkage 2 is enclosed by the first coil spring 5. The link 5 is enclosed by the second coil spring 6. One end of the link 5 is fixed to the slide guide 3, and the other end thereof is fixed to the bell crank 9.

In operation, the trigger member 8 is pushed back into the plunger as an active door is closed, the bell crank 9 moves to push the slide guide 30 upwardly through the link 5 to move the elongated rod type linkage 2 upwardly and make sure the latch bolt 7 is inserted into a strike in a door lentil (not shown). The horizontal movement of the trigger member 8 is transferred to the vertical movement of the link 5 by means of the bell crank 9. This tends to give rise to abrasive wear of the bell crank 9 after repeated use. The service life of such flush bolt mechanism is thus undesirably reduced.

It is therefore greatly desired to provide a new and improved flush bolt mechanism suitable for double swing doors.

SUMMARY OF THE INVENTION

In view of the above, an objective of the present invention is to an automatic flush bolt mechanism, which is capable of automatic operation between an engaged position when the active door is closed, and a disengaged position when the active door is open again.

Another objective of the present invention is to a flush bolt mechanism, which has a durable service life, and all the parts of the flush bolt mechanism are capable of operating smoothly.

In order to achieve the above and others objectives, the present invention provides a flush bolt mechanism for flush mounting on a free edge of one of a pair of active and inactive swing doors and operation between an engaged position and a disengaged position. The flush bolt mechanism includes a mounting assembly, a trigger assembly, and a linkage assembly.

The frame assembly includes a substantially flat sheet adapted for flush mounting on the free edge of one of the swing doors, and a support bracket secured to the flat sheet. The flat sheet has an opening defined therein. The bracket has two vertical first slots defined therein.

The trigger assembly includes a slide guide bracket secured to the flat sheet having two parallel first slots, a plunger, and a trigger member. The plunger is reciprocally retained in the slide guide bracket. The plunger includes a central portion and a pair of opposite wing portions extending substantially perpendicularly from the central portion and a shaft. The wing portions respectively have two parallel second slots. The shaft extends through the first and second slots and is movable along the first and second slots. The trigger member has one end mounted to the plunger. The trigger member is reciprocally movable relative to the flat sheet between a retracted position whereat the trigger member extends through the opening of the flat sheet, and an extended position whereat the trigger member is retracted within the slide guide bracket. The first and second slots of the slide guide bracket and the plunger are offset at an angle.

The linkage assembly includes a linkage member, a post having a first end secured to the linkage member and a second opposite end coupled to the shaft, a rod link having a first end fixed to the linkage member and opposing to the post, the rod link extending through the support bracket, a resilient member disposed between the support bracket and the linkage member; and a latch bolt having a first end fixed to a second opposite end of the rod link.

In operation, when the active door is in a closed position, the trigger member is triggered to be in the corresponding retracted position, the shaft carries the post to an uppermost position, thereby the latch bolt is correspondingly moved upwardly for latching engagement in a strike of an associated sash; when the active door is in a opened position, the resilient member biases the shaft and the post to a lowermost position, thereby the trigger member is changed into the extended position, and the latch bolt is simultaneously moved downwardly for disengagement with the strike.

Other objects, advantages and novel features of the invention will become more apparent from the following detailed description when taken in conjunction with the accompanying drawings, in which:

DETAILED DESCRIPTION OF THE PREFERRED EMBODIMENTS

Reference will now be made to the drawings to describe the embodiments of the present invention in detail.

Figure 1:
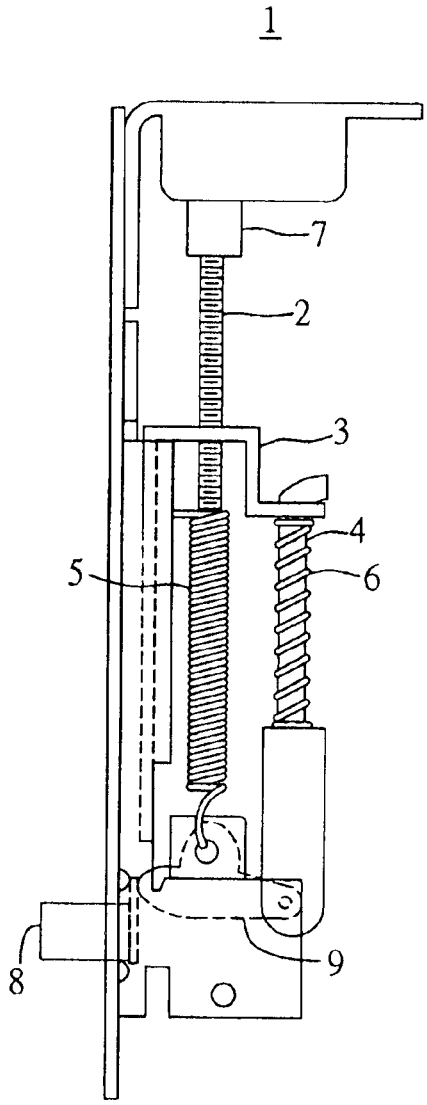
FIG. 1 (PRIOR ART)
FIG. 1 (PRIOR ART) is a vertical elevation view showing a conventional flush bolt mechanism in a disengaged position.
Figure 2:
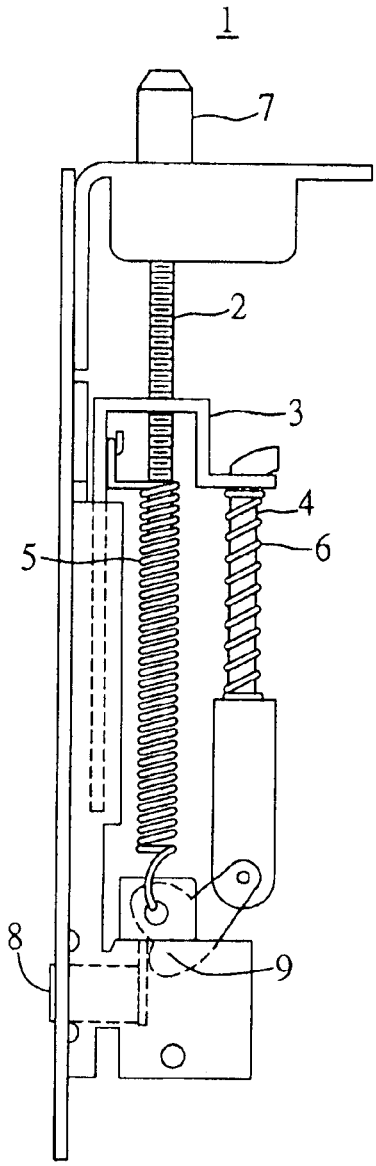
FIG. 2 (PRIOR ART)
FIG. 2 (PRIOR ART) is a vertical elevation view showing the flush bolt mechanism of FIG. 1 in an engaged position.
Figure 3:
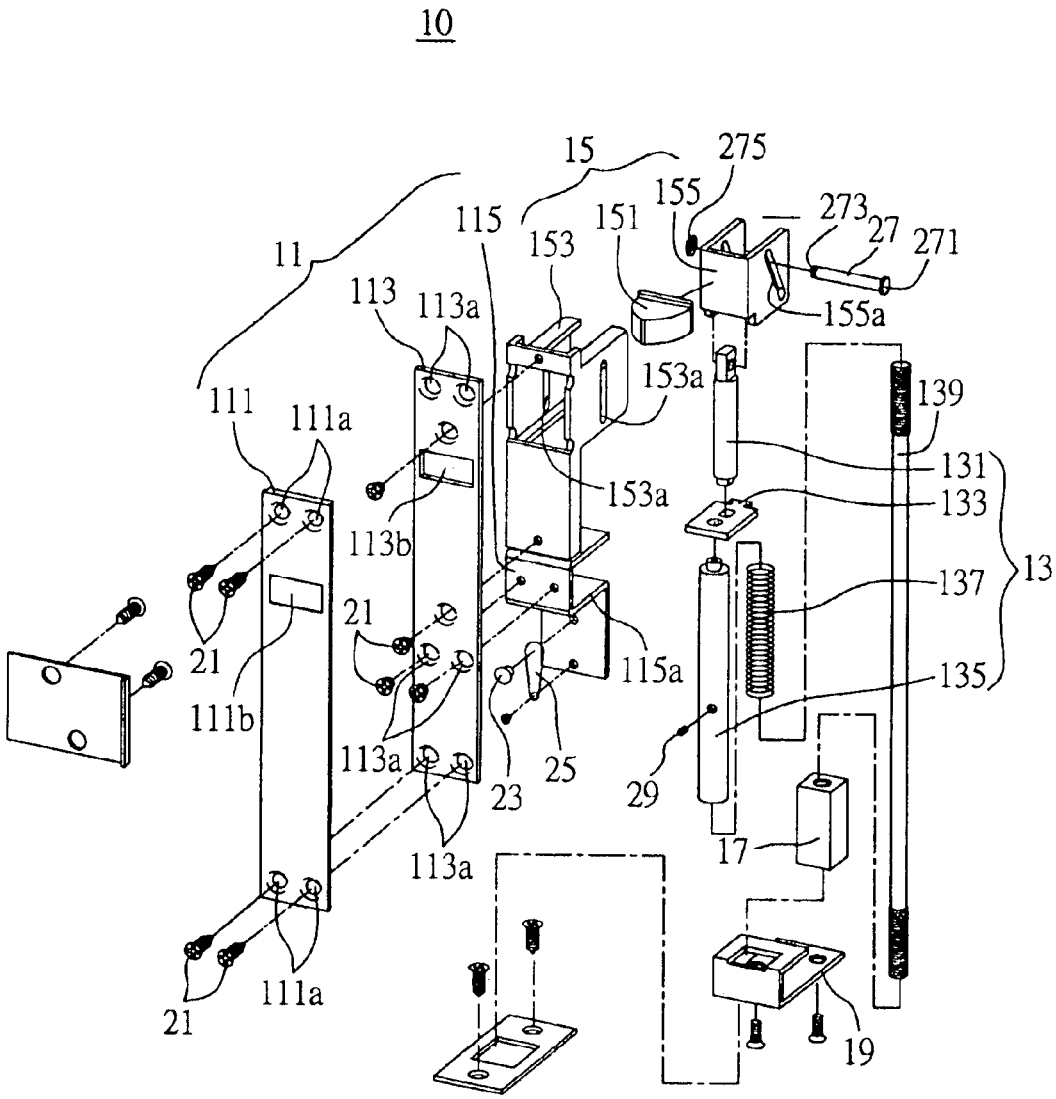
FIG. 3 is an exploded view of a flush bolt mechanism according to the present invention.
Figure 4:
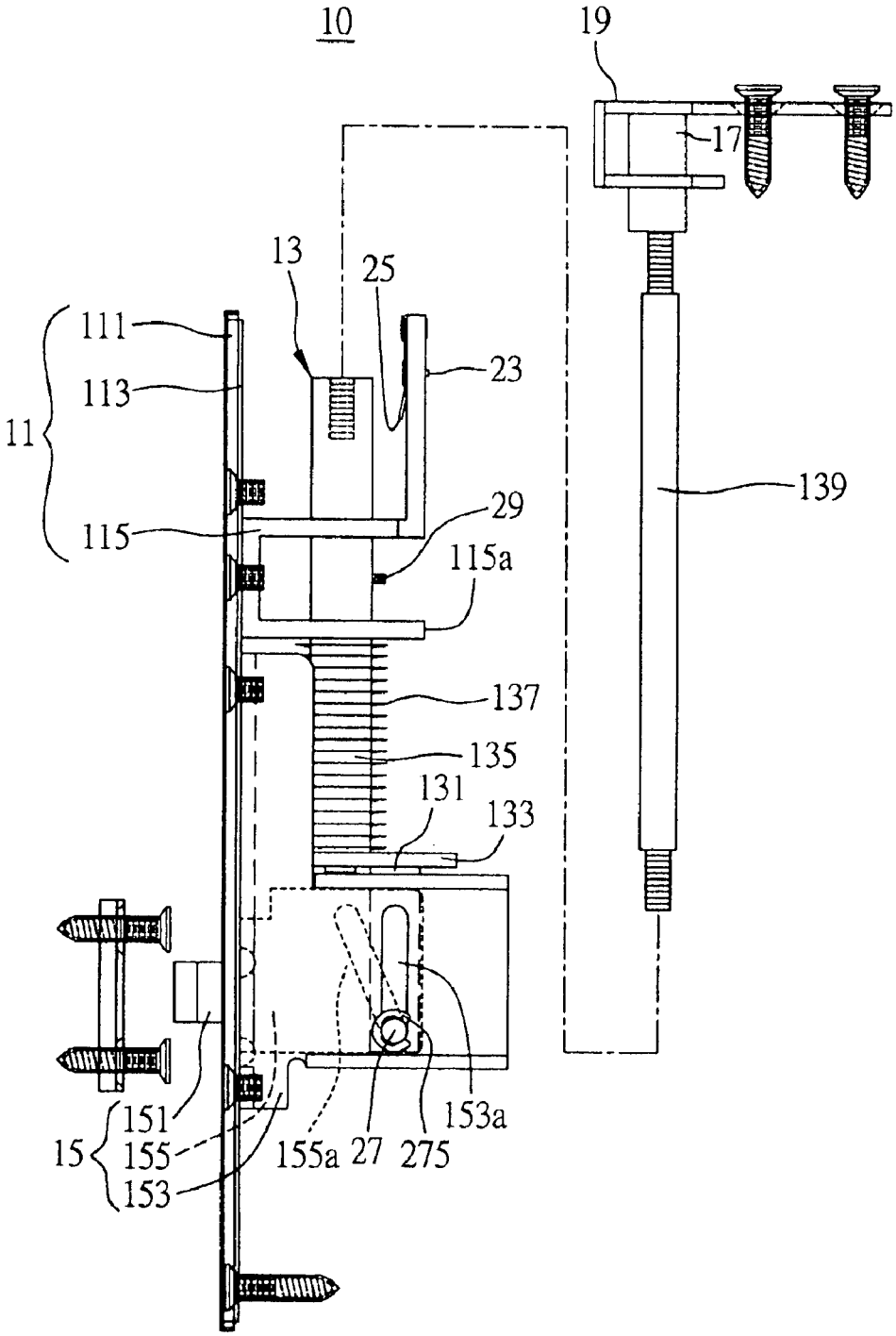
FIG. 4 is a partially assembled view of the flush bolt mechanism according to the present invention.

Referring to FIGS. 3 and 4, a flush bolt mechanism constructed according to a preferred first embodiment of the present invention is generally designated with reference numeral 10. The flush bolt mechanism 10 generally flush mounts in a cavity on a vertical free edge of an inactive door (not shown) of double swing doors and operation between an engaged position and a disengaged position; alternatively, the flush bolt mechanism 10 may also be mounted on an active door (not shown) of the double swing doors. The flush bolt mechanism 10 comprises a mounting assembly 11, a linkage assembly 13, and a trigger assembly 15, a bolt header 17, and a guide 19, wherein the guide 19 is mounted on a frame (not shown) within which the swing doors are received, and the bolt header 17 is allowed to reciprocally extend through the guide 19. It should be noted that bolt mechanism 10 may be employed to project a latch link 139 to engage in a strike arranged in either a horizontal head jamb or a threshold of a doorway. For purposes of illustration only, the description will be directed primarily to a bolt mechanism mounted to project a latch bolt at a top of the inactive door.

The mounting assembly 11 comprises a front flat plate 111 adapted for mounting on the free edge of the inactive door, a rear flat plate 113 fastened to the front flat plate 111, a support bracket 115 secured to the rear flat plate 113. The front and rear plates 111 and 113 respectively define a plurality of screw holes 111*a* and 113*a* therein for extension of fasteners such as screws 21 therethrough to fasten the rear plate 113 to the front plate 111, and secure the support bracket 115 to the rear plate 113. The front and rear flat plates 111 and 113 further respectively include an opening 111*b* and an opening 113*b*, for extension of a trigger member 151 to be discussed in more detail below. The support bracket 115 is generally secured to a substantially central portion of the rear plate 113. The support bracket 115 has a guide hole (invisible in FIG. 3) defined therein for guiding vertical movement of the linkage assembly 13. A reined spring 25 is preferably fixed to the support bracket by a heat fusible stud 23. When a fire breaks out, the stud 23 is fused and melted by the fire under high temperatures, the reined spring then exerts a force upon the latch bolt to ensure a latching state of the inactive door.

The trigger assembly 15 generally comprises the trigger member 151, a slide guide bracket 153, and a plunger 155. The slide guide bracket 153 is secured to a lower portion of the rear flat plate 113 by fasteners 21. Two vertical parallel slots 153*a* is defined in opposite sidewalls of the slide guide bracket 153; alternatively, the two parallel slots 153*a* may also be slanted (not shown). The plunger 155 is reciprocally movable and retained in the slide guide bracket 153. The plunger 155 includes a central portion and a pair of opposite wing portions extending substantially perpendicularly from the central portion and a shaft 27. The wing portions define two parallel slanted slots 155*a* respectively for movingly accommodating the shaft 27 therein. The shaft 27 has a header 271 at one end and a circular groove 273 defined in the other end for engagement with a C-shaped ring 275. Size of the header 271 is larger than a width of the slanted slots 155*a*. The trigger member 151 includes a beveled end and a mounted end mounted to the plunger 155. The trigger member 151 is reciprocally movable relative to the front and rear flat plate 111 and 113 between an extended position whereat the trigger member 151 extends through the openings 111*b* and 113*b* of the front and rear flat plate 111 and 113, and a retracted position whereat the trigger member 151 is retracted within the slide guide bracket 153.

Figure 5:
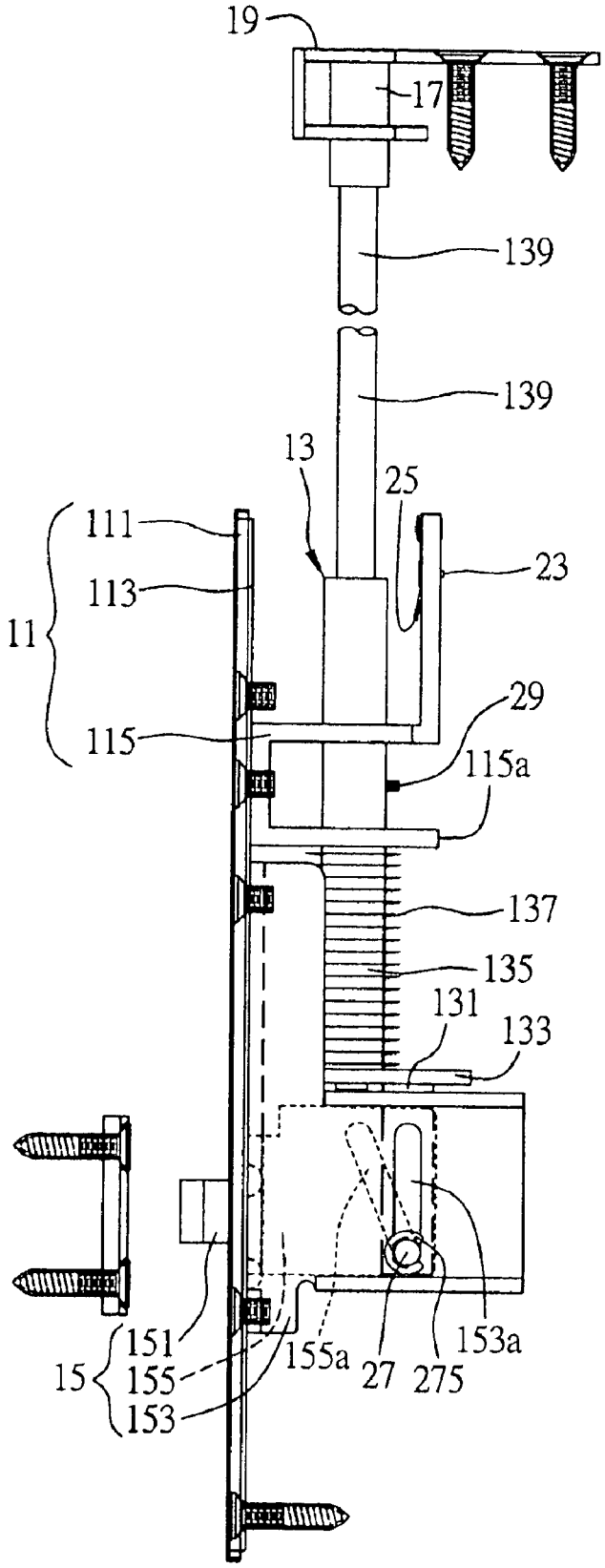
FIG. 5 is a vertical elevational view of the flush bolt mechanism according to the present invention in a disengaged position.
Figure 6:
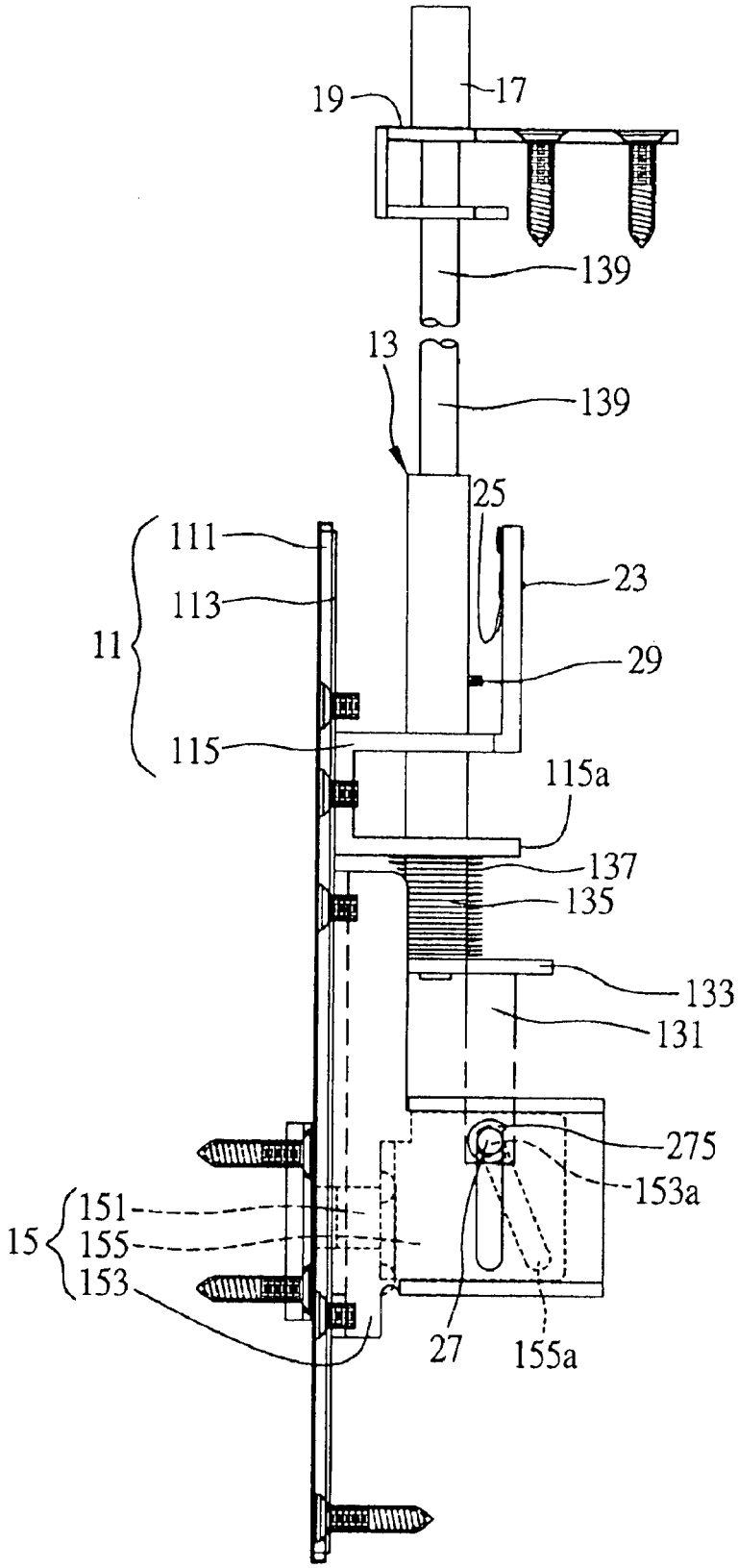
FIG. 6 is a vertical elevational view of the flush bolt mechanism according to the present invention in an engaged position.

The linkage assembly 13 generally comprises a post 131, a linkage plate 133, a rod link 135, a resilient member 137, the latch link 139, and a bolt header 17. The post 131 has a first end fixed to the linkage plate 133 and a through hole defined in a second opposite end thereof. The rod link 135 has a first end fixed to the linkage plate 133, opposing to the post 131. The rod link 135 extends through the opening of the support bracket 115. A second opposite end of the rod link 135 has a threaded bore (not labeled) defined. The resilient member 137 such as a coil spring encloses a portion of the rod link 135, and is disposed between the support bracket 115 and the linkage plate 133. A reined element 29 such as a screw is preferably disposed in the rod link 135, for restricting movement of the rod link 135. The latch link 139 has a first threaded end for threaded engagement in the threaded bore of the rod link 135, and a second opposite threaded end. The bolt header 17 is in threaded engagement with the second end of the latch link 139 and is dimensioned and configured to be fittingly reciprocally movable through the guide 19. In assembly, referring to FIGS. 4–5, The mounting assembly 11 is mounted on the free edge of the inactive door. The guide 19 is mounted in the recess in the top surface of the inactive door by fastens. The slide guide bracket 153 is secured to a lower portion of the rear flat plate 113 by fasteners 21. The plunger 155 is reciprocally retained in the slide guide bracket 153. The trigger member 151 is attached to the central portion of the plunger 155. The shaft 27 extends through the through hole of the post 131, the slanted slots 155*a* of the plunger 155, and the vertical slots 153*a* of the slide guide bracket 153. The header 271 of the shaft 27 and the C-shaped ring 275 fit over the vertical slots 153*a* of the slide guide bracket 153, respectively. The linkage assembly 13 extends through the support bracket 115, with one end of the post is coupled to the shaft 37 and the bolt header 17 extends into the guide 19.

In operation, when the active door is in a closed position, the trigger member is triggered to be in the corresponding retracted position, whereat the trigger member 151 is retracted within the slide guide bracket 153. Simultaneously, the shaft 27 carries the post 131 along the vertical and slanted slots 153*a*, 155*a* to an uppermost position. Thereby the bolt header 17 is correspondingly moved upwardly to latchingly engage in the strike of the associated sash in the doorway. When the active door is in an opened position, the resilient member 137 biases the shaft 27 and the post 131 along the vertical and slanted slots 153*a*, 155*a* to a lowermost position. Correspondingly, the trigger member is changed into the extended position, whereat the trigger member 151 extends through the openings 111*b* and 113*b* of the front and rear flat plate 111 and 113. Thereby the bolt header 17 is moved downwardly and disengage with the strike.

In an alternative second embodiment, most structure of a flush bolt mechanism of the second embodiment is similar to the structure of the flush bolt mechanism of the first embodiment. However, slanted slots are defined in the slide guide bracket and are oriented in a direction opposite to the orientation of the slanted slots of the first embodiment, and correspondingly, vertical slots are arranged in the opposite wing portions of the plunger.

Similarly, in operation, when the active door is closed, the trigger member is retracted within the slide guide bracket. Simultaneously, the shaft carries the post along the vertical and slanted slots to an uppermost position. Thereby the bolt header is correspondingly moved upwardly to latchingly engage in the strike of the associated sash in the doorway. When the active door is open, the resilient member biases the shaft and the post along the vertical and slanted slots to a lowermost position. Correspondingly, the trigger member extends through the openings of the front and rear flat plate. Thereby the bolt header is moved downwardly and disengage with the strike.

It should be noted that for the purposes of illustrating the present invention, the above-described slanted slots of the plunger and the vertical slots of slide guide bracket of the first embodiment, and the vertical slots of the plunger and the slanted slots of the slide guide bracket of the second embodiment have been selected to transfer a horizontal movement of the trigger member to a vertical movement of the linkage assembly, and are not intended to limit the present invention. Said vertical orientation of the slots is not critical to practice the present invention. As long as the slots of the plunger and the slide guide bracket are offset at an angle, a variety of equivalent modifications, which are known to those skilled in the art, may be suitably adopted.

In the present invention, the trigger member on the free edge of the inactive door senses whether or not the active door is closed. When the active door is closed, the trigger member causes the flush bolt to automatically change into the engaged position, when the active door is open again, the trigger releases causing the flush bolt to automatically return to the disengaged position.

While the preferred embodiment in accordance with the present invention has been shown and described, equivalent modifications and changes known to persons skilled in the art according to the spirit of the present invention are considered to be within the scope of the present invention as defined in the appended claims.

What is claimed is:

1. A flush bolt mechanism mounted on a free edge of one of a pair of active and inactive swing doors received in a frame, the flush bolt mechanism comprising:

a mounting assembly comprising at least one substantially flat plate mounted on the one of the active and inactive swing doors, and a support bracket secured to the flat plate;

a trigger assembly connected to the mounting assembly, the trigger assembly comprising a trigger member reciprocally movable relative to the flat plate, a slide guide bracket secured to the flat plate, and a plunger reciprocally movable and mounted in the slide guide bracket, the plunger connected to the trigger member;

a linkage assembly connected to the trigger assembly, the linkage assembly comprising a post having a first end slidingly mounted in the plunger, a linkage plate coupled to a second opposite end of the post, a rod link having a first end connected to the linkage plate and opposed to the post, a resilient member surrounding the rod link, and a latch link having a first end connected to a second opposite end of the rod link;

a bolt header connected to a second opposite end of the latch link; and a guide mounted on the frame and corresponding in position to the bolt header;

wherein when the active swing door is in a closed position relative to the inactive swing door, the trigger member is retracted and drives the plunger to move the post and thereby drive the linkage assembly to allow the bolt header to be engaged with the guide; when the active swing door is in an opened position relative to the inactive swing door, the resilient member of the linkage assembly biases the post to allow the trigger member to extend out of the flat plate, such that the bolt header is disengaged from the guide.

2. The flush bolt mechanism as described in claim 1, wherein the at least one flat plate comprises a front flat plate mounted on the swing door, and a rear flat plate connected to the front flat plate.

3. The flush bolt mechanism as described in claim 2, wherein the front and rear flat plates are each formed with a plurality of screw holes and an opening.

4. The flush bolt mechanism as described in claim 2, wherein the support bracket is secured to the rear flat plate.

5. The flush bolt mechanism as described in claim 2, wherein the support bracket is secured to a central portion of the rear flat plate.

6. The flush bolt mechanism as described in claim 1, further comprising a reined spring fixed to the support bracket by a heat fusible stud.

7. The flush bolt mechanism as described in claim 1, further comprising a reined element disposed in the rod link for restricting movement of the rod link.

8. The flush bolt mechanism as described in claim 7, wherein the reined element is a screw.

9. The flush bolt mechanism as described in claim 1, wherein the slide guide bracket has two parallel first slots formed on two opposite walls of the slide guide bracket respectively.

10. The flush bolt mechanism as described in claim 9, wherein the plunger comprises a central portion, a pair of opposite wing portions extending from the central portion, and a shaft.

11. The flush bolt mechanism as described in claim 10, wherein two parallel second slots are formed on the opposite wing portions respectively, and the shaft penetrates through the first and second slots and is movable along the slots.

12. The flush bolt mechanism as described in claim 1, wherein the resilient member is disposed between the support bracket and the linkage plate.

13. The flush bolt mechanism as described in claim 1, wherein the resilient member is a spring.

14. The flush bolt mechanism as described in claim 2, wherein the slide guide bracket is secured to the rear flat plate by a plurality of fasteners.

15. The flush bolt mechanism as described in claim 14, wherein the fasteners are screws.

16. The flush bolt mechanism as described in claim 11, wherein the shaft has one end formed with a header and the other end formed with a groove, and the groove is engaged with a C-shaped ring when the shaft penetrates through the first and second slots.

* * * * *